United States Patent [19]

Raasch et al.

[11] Patent Number: 4,458,477

[45] Date of Patent: Jul. 10, 1984

[54] METHOD AND DEVICE FOR MANUFACTURING A THREAD

[75] Inventors: Hans Raasch; Heinz-Georg Wassenhoven, both of Monchen-Gladbach, Fed. Rep. of Germany

[73] Assignee: W. Schlafhorst & Co., Monchen-Gladbach, Fed. Rep. of Germany

[21] Appl. No.: 469,979

[22] Filed: Feb. 25, 1983

[30] Foreign Application Priority Data

Feb. 27, 1982 [DE] Fed. Rep. of Germany ..... 3207136

[51] Int. Cl.[3] ..... D01H 7/882

[52] U.S. Cl. ..... 57/415; 57/411; 57/417

[58] Field of Search ..... 57/404, 411, 414, 415, 57/417

[56] References Cited

U.S. PATENT DOCUMENTS 3,999,362 12/1976 Schulz et al. ..... 57/417 X
4,044,537 8/1977 Negishi et al. ..... 57/417 X
4,258,541 3/1981 LeChatelier et al. ..... 57/417
4,322,942 4/1982 Fajt et al. ..... 57/411
4,339,910 7/1982 Ali et al. ..... 57/411

*Primary Examiner*—John Petrakes
*Attorney, Agent, or Firm*—Herbert L. Lerner; Laurence A. Greenberg

[57] ABSTRACT

A method for manufacturing a thread, includes introducing fibers into a rotor having a fiber collecting groove, combining the fibers in the collecting groove into a fiber ring gradually converting into a thread, conducting the thread in a given travel direction through a pneumatic twisting device discharging a quantity of air, bringing the thread in contact with an air stream in the pneumatic twisting device which rotates around the longitudinal axis of the thread against the given travel direction of the thread, conducting fibers loosened from the thread back into the rotor with at least part of the quantity of air discharging from the pneumatic twisting device, drawing off the twisted thread leaving the pneumatic twisting device, and conducting the twisted thread to a thread collecting device, and a device for carrying out the method.

23 Claims, 9 Drawing Figures

FIG. 1
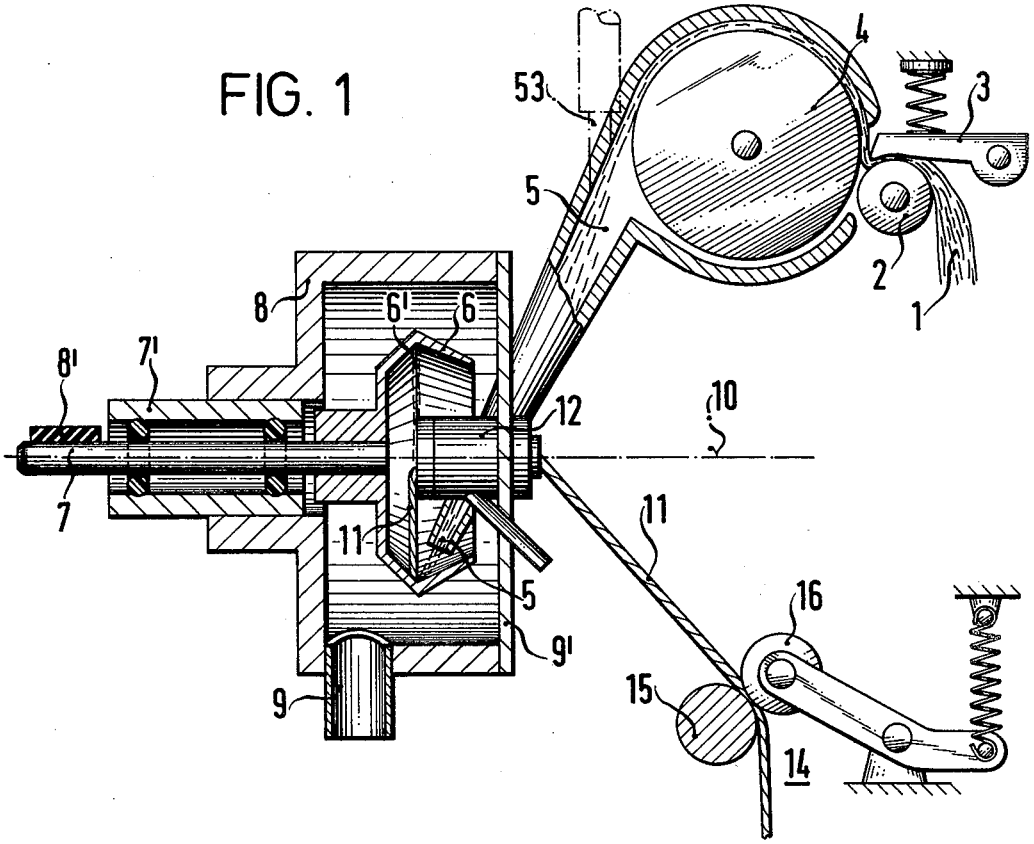
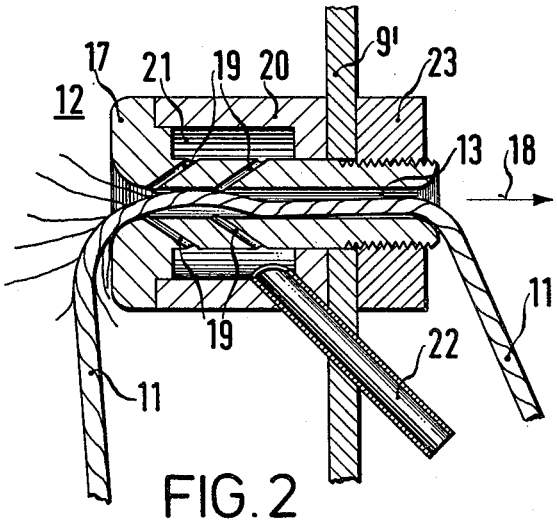
FIG. 2
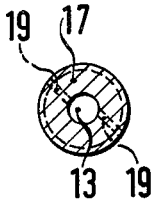
FIG. 3

FIG. 6
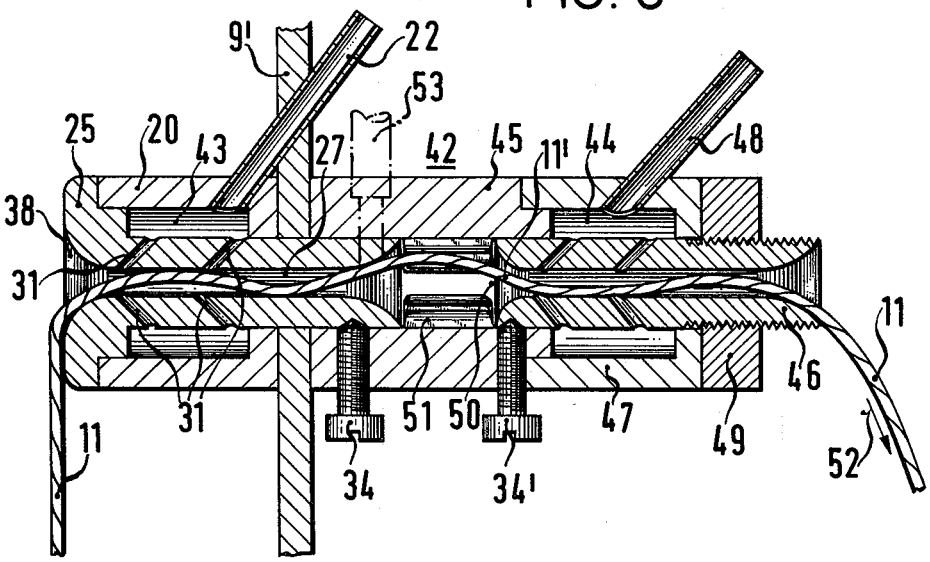
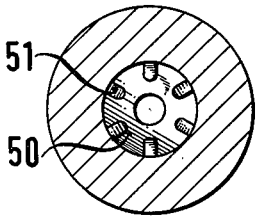
FIG. 7
FIG.8
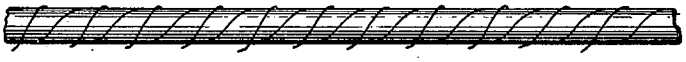
FIG.9
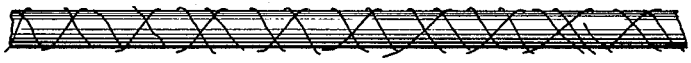

METHOD AND DEVICE FOR MANUFACTURING A THREAD

The invention relates to a method and a device for manufacturing a thread, wherein the fibers are introduced into a rotor having a fiber collecting trough, and are combined therein into a fiber ring which gradually is converted into a thread. Accordingly, the invention relates to a method and a device for use in open-end spinning.

It has been attempted in the past during an open-end spinning operation, to wind longer fibers which protrude around the thread, and to remove the shorter fibers which protrude.

However, the removal of short fibers by blowing or similar means has certain particular disadvantages. Even if the position is taken that the short fibers only contribute slightly to the strength of the thread, they are still a part of the total fiber mass which is set in the rotor for the spinning process. The thread exhibits disadvantageous variation of its mass after the short fibers have been removed.

It is accordingly an object of the invention to provide a method and device for manufacturing a thread, which overcome the herein-aforementioned disadvantages of the heretofore-known methods and devices of this general type, to increase the spinning speed, to add to the strength of the thread, to thereby maintain its average mass value in an unchanged condition as set in the rotor for the spinning operation, and to ensure that no fibers are lost.

With the foregoing and other objects in view there is provided, in accordance with the invention, a method for manufacturing a thread, which comprises introducing fibers into a rotor having a fiber collecting groove or trough, combining the fibers in the collecting groove into a fiber ring gradually converting into a thread, conducting the thread in a given travel direction through a pneumatic twisting device discharging a quantity of air, bringing the thread in contact with an air stream in the pneumatic twisting device which rotates around the longitudinal axis of the thread against the given travel direction of the thread, conducting fibers loosened from the thread, and no longer having a connection with the thread, back into the rotor with at least part of the quantity of air discharging from the pneumatic twisting device, drawing off the twisted thread after leaving the pneumatic twisting device, and then conducting the twisted thread to a thread collecting device.

The invention makes it possible to spread out additional fiber endings besides the fibers already protruding from the thread surface, and to wind these fibers around the thread by means of the rotating air stream. Up to 50% of all fibers can be wound around the remaining thread core in this manner, so that the thread is not only made stronger with respect to its tensional strength, but its appearance is also improved.

At 5 to 15%, the portion of loosened fibers is rather high. If these fibers were not returned to the rotor again, as is the case in the invention, a non-permissible weakening and uneven mass distribution of the thread would result. However, in this case, the fibers are continuously re-conducted into the fiber strand or sliver so that the return flow of fibers stabilizes after a short starting time, and a homogenous fiber strand in the form of a thread is pulled from the pneumatic twisting device.

The return flow of the fibers into the rotor is most simply accomplished if, in accordance with another mode of the invention, there is provided a method which comprises providing an initial deflection of the thread along the direction of the axis of rotation of the rotor at a deflection point, and bringing the thread in contact with the rotating air stream directly downstream of the deflection point for contrally conducting air and fibers into the rotor. Because of the air which also rotates in the interior of the rotor, the returning fibers are caused to rotate in the same sense as the rotor, and attach themselves to the fibers already present in the fiber collection trough of the rotor. At the deflection point, the thread is deflected about 90° . At this point, the spreading of the fiber ends which are later wrapped around the thread, is especially easy.

In order to carry out the method, there is provided a device for manufacturing a thread in an open-end rotor spinning machine, comprising a rotor housing subjected to negative pressure, a rotor being disposed in the housing and having a fiber collecting groove for receiving a continuous supply of fibers and forming a fiber ring due to centrifugal forces being converted into a thread, a pneumatic twisting device being connected to the housing and having a thread guide channel formed therein through which the thread is conducted in a given travel direction, the thread guide channel having an opening for discharging in the housing, and the thread guide channel conducting air therethrough against the given thread travel direction at least at the opening thereof.

In accordance with a further feature of the invention, there is provided a thread draw-off device for receiving the thread from the pneumatic twisting device.

In accordance with an added feature of the invention, there is provided a thread collecting device for receiving the thread from the pneumatic twisting device or thread draw-off device.

The proposed device makes certain that no fibers are lost, and that the thread is uniformly drawn or pulled out and collected in a controlled manner. The negative pressure maintained in the rotor housing can be externally produced, but it can also be generated by the rotor itself, by constructing the rotor parts in such a way that a ventilating effect is produced.

In accordance with an additional feature of the invention, the opening of the thread guide channel is a funnel-shaped expanded thread draw-off nozzle disposed in the rotor. The continuously pulled thread rolls off on the surface of the funnel-shaped thread draw-off orifice. It also acquires its twist at the orifice. The path length of the fibers which are returned back is shortest in this type of configuration. This enhances the homogeneity of the thread.

In accordance with again another feature of the invention, the pneumatic twisting device is a twist generator having orifices, nozzles or channels formed therein for directing air tangentially against the thread.

In accordance with again a further feature of the invention, the pneumatic twisting device is a twist generator having orifices, nozzles or channels formed therein for directing air obliquely against the given travel direction of the thread. It is advantageous to construct the nozzles, orifices and channels in such a way that they terminate in the thread guide channel from different sides.

In accordance with again an added feature of the invention, the tangential directional component of the orifices faces in the same direction as the direction of rotation of the rotor. In this case, the outer fibers are wound in the same direction as the basic rotation in the sliver and in the thread core. This occurs without stronger stresses on the thread.

However, in accordance with again an additional feature of the invention, the tangential directional component of the orifices faces in the direction opposite the direction of rotation of the rotor. In this case, greater pneumatic forces must be applied, because the outer fibers are now wound around the thread core in a direction opposite the basic rotation of the sliver. Both possibilities have their advantages. It depends on the fiber material, on the thread, and on other spinning conditions, if it is better to wind the outer fibers around the thread core in the same sense or in an opposing sense.

In accordance with yet another feature of the invention, the pneumatic twisting device includes at least one other twist generator connected in series with the first-mentioned twist generator one behind the other, and the opening is a common opening for each of the twist generators and is disposed in the rotor housing. Accordingly, the amount of air flowing through the thread guide channels of the individual twist generators increases in direction toward the rotor housing.

Generally, two twist generators disposed in series are sufficient. It is also more effective to provide two twist generators, instead of only one.

In accordance with yet a further feature of the invention, the pneumatic twisting device has a respective balloon chamber formed therein between each two twist generators for forming a thread balloon. Only one balloon chamber is provided between two twist generators in series.

In accordance with yet an added feature of the invention, there are provided disturbance elements being disposed in the balloon chambers and being contacted by the thread balloon during rotation. The purpose of these elements is to loosen the thread surface, so that more extending threads can be wound around the thread core.

If several twist generators are used, the rotational direction of the air streams which encircle and influence the thread can be the same. However, it is more advantageous if, in accordance with yet an additional feature of the invention, the air being conducted through the thread guide channel influences and encircles the thread in a different direction of rotation from one of the twist generators to the next. This is due to the fact that in this case the thread core does not rotate in the balloon chamber between the twist generators or in the space between them, so that the fibers can spread out especially well there. If the first twist generator turns in the opposite direction than the rotor, and the second twist generator in the same direction, then the basic rotation and the outer fibers are turned in the same sense. If the first twist generator turns in the same direction as the rotor, and the second twist generator turns in the opposing sense, a thread with the outer fibers turned against the fibers of the core is obtained.

In accordance with still a further feature of the invention, the air conducted through the thread guide channel influences and encircles the thread with a different intensity in each of the twist generators. In this case, it can be advantageous to operate both twist generators in the same direction.

In accordance with still another feature of the invention, the housing includes a cover, the pneumatic twisting device is exchangeably mounted in the cover and can be exchanged for a thread draw-off orifice without a twisting device. In this manner, it becomes possible to perform the spinning operation by choice with or without pneumatic twisting devices. This widens the operational scope of the spinning device. Finer threads are better spun with a pneumatic twisting device, while for coarser threads, the spinning operation is performed without a twisting device using a simple draw-off orifice.

In accordance with still an added feature of the invention, the pneumatic twisting device includes a discharge line originating from the thread guide channel or the thread balloon chamber.

In accordance with still an additional feature of the invention, the discharge line discharges in the rotor.

In accordance with a concomitant feature if the invention, the discharge line discharges in a feed channel supplying the fibers to the rotor.

Other features which are considered as characteristic for the invention are set forth in the appended claims.

Although the invention is illustrated and described herein as embodied in a method and device for manufacturing a thread, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a simplified diagrammatic longitudinal-sectional view, partly broken away, of a device according to the invention;

FIG. 2 is a longitudinal sectional view of the associated pneumatic twisting device;

FIG. 3 is a cross-sectional view of a part of the pneumatic twisting device;

FIG. 6 is a longitudinal-sectional view of a third pneumatic twisting device;

FIG. 7 is a cross-sectional view of the balloon chamber of the third twisting device;

FIG. 8 is an elevational view of a thread resulting from the spinning process, wherein the inner fibers have the same twist as the outer fibers; and FIG. 9 is a view similar to FIG. 8 of a thread resulting from the spinning process, wherein the outer fibers have a different twist than the inner fibers.

Figure 4:
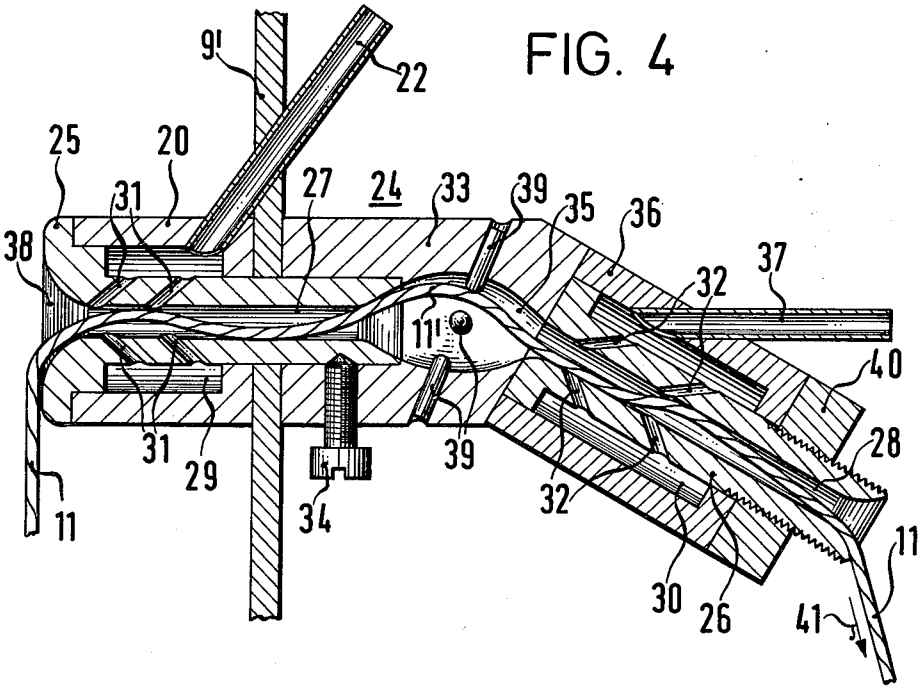
FIG. 4 is a longitudinal-sectional view of another pneumatic twisting device.

Referring now to the figures of the drawing in detail and first particularly to the first embodiment of the invention according to FIGS. 1 to 3 thereof, it is seen that a fiber strand or sliver 1 is fed past an insertion roller 2 assisted by the clamping action of an insertion trough 3, to a rotating separating roller 4. The separating roller 4 is provided with a set of saw teeth which are not shown in the figure. The saw teeth dissolve the sliver down to its individual fibers. The fibers are conducted through a feed channel 5 into the interior of a rotor 6. In the rotor 6, the fibers slide into a fiber collection groove 6' through the action of centrifugal forces. The fibers are combined in the groove 6' into a fiber ring, which gradually continues to form a twisted thread 11.

The rotor 6 is supported on a shaft 7 in a bearing journal 7'. The bearing journal 7' is disposed in an opening of a rotor housing 8. The shaft 7 of the rotor is directly driven by a tangential belt 8'.

The interior of the rotor housing 8 is connected through a connection pipe 9 to a source of negative pressure or suction which is not further illustrated. A detachable cover 9' closes off the rotor housing 8 from the outside. Thus, a negative pressure is maintained in the interior of the rotor housing 8.

As seen along a rotor axis 10, a pneumatic twisting device 12 is fastened to the cover 9'. According to FIG. 2, the pneumatic twisting device 12 has a central thread-guiding channel 13 through which the thread 11 is conducted. FIG. 2 shows that the thread-guiding channel 13 terminates in the interior of the rotor housing 8. Outside the pneumatic twisting device 12, is a thread draw-off device 14, which is formed of a continuously rotating pulling roller 15 and a spring-loaded contact roller 16. Downstream of the thread draw-off device 14, is a non-illustrated thread collecting device. For example, the thread collecting device could be a winding device, which coils the thread onto a spool.

The pneumatic twisting device 12 contains a twist generating element 17 which is provided with several channels 19 that are directed tangentially against the thread 11, and are obliquely oriented against the direction of the thread motion indicated by an arrow 18. The cross-sectional view of FIG. 3 shows that the channels 19 terminate in pairs from opposite sides in the thread guide channel 13. A sleeve 20 surrounds the twist generator 17 in such a manner that an annular channel 21 is formed, in which a connection tube 22 terminates. Compressed air is introduced through the connection tube 22 into the annular channel 21 from a non-illustrated compressed air source, and flows from the channel 21 through the channels 19 into the thread-guide channel 13, where the compressed air forms a turbulent air flow directed against the travel direction of the thread. The turbulent flow causes the thread 11 to rotate with a spinning motion. The outer end of the twisting device 17 is provided with a screw thread which carries a nut 23, that securely clamps the whole pneumatic twisting device 12 to the cover 9'.

In this typical embodiment, the channels 19 are formed in such a way that a Z-rotation or twist is forced upon the outer fibers of the thread by the turbulent flow in the interior of the twist generator. If the rotor 6 turns in a clockwise direction, there is also a Z-rotation or twist given to the whole thread by the rotor. The two rotations are added to each other.

If the draw-off velocity of the thread 11 from the rotor 6 is adjusted in such a way that only a slight thread twist is generated by the rotation of the rotor, it is possible to apply an additional thread twist to the thread with the pneumatic thread twisting device, so that in this case the thread obtains the strength required to be drawn-off, which is accomplished for the first time through the use of the invention.

If none of the fibers would spread out and arrange themselves around the thread core, the pneumatic twisting device would only introduce a temporary twist to the thread, which would thereafter dissolve itself again. However, the individual fibers which spread out form an open end. They wind themselves around the remaining thread core, and their twist remains unchanged.

The thread withdrawal velocity of a conventional open-end rotor spinning machine is limited. In particular, the rotational velocity of the rotor has a technological limit due to its bearings. If the thread draw-off velocity is increased at will, the thread twist becomes insufficient. However, a special advantage of the pneumatically operating twisting device according to the invention is that it can operate with very high rotational speeds of the air stream, so that it becomes possible to achieve a very high thread withdrawal speed with a sufficient twist of the outer fibers, without operating the rotor at a high speed of revolutions.

FIG. 4 shows a sectional view through another pneumatic twisting device 24. A first twist generator 25 is placed through a hole in the cover 9'. The first twist generator 25 is provided with a central thread guide channel 27, and is surrounded in the interior of the rotor housing by a sleeve 20 as in the first embodiment, so that an annular channel 29 is formed. The connection tube 22 which is also provided in the first embodiment, terminates in the annular channel 29. Channels 31 which connect the annular channel 29 with the thread guide channel 27 are oriented in the same way as in the first embodiment. The ending of the thread guide channel 27 is also funnel-shaped and rounded off in this case, to form a draw-off nozzle for the thread 11 in the interior of the rotor housing.

A tube 33 is pushed over the twist generator 25 outside of the rotor housing, and is secured by a clamping screw 34 in such a manner that a strong connection of the parts with each other and with the cover 9' is formed.

The tube 33 forms a balloon chamber 35 downstream of the twist generator 25. A second twist generator 26 is disposed downstream of the balloon chamber and is tilted relative to the horizontal plane. The second twist generator 26 has a central thread guide channel 28 formed therein. The channel 28 is surrounded by a sleeve 36, so that an annular channel 30 is formed. A connection tube 37 terminates in the annular channel 30. In this case as well, both connection tubes 22 and 37 are connected to a non-illustrated source of compressed air. Channels 32 which connect the annular channel 30 with the thread guide channel 28, correspond to the channels 31 of the first twist generator 25. However, the channels 32 have a different tangential flow direction with respect to the thread 11.

FIG. 4 shows that both twist generators or the thread guide channels thereof have a common end in the interior of the rotor housing. However, the rotor housing itself is not shown in this embodiment. The balloon chamber 35 is provided with disturbance elements 39 in the form of pins. The disposition of the pins 39 is shown in FIG. 4 and also in FIG. 5 in cross section.

The end of the twist generator 26 has a screw thread with a nut 40, connecting the twist generator 26 with the sleeve 36.

While the thread 11 is pulled through the pneumatic twisting device 24 in the direction of an arrow 41, it is caused to vibrate in the form of a wave due to the air streams, and forms a thread balloon 11' in the balloon chamber 35. In the locations at which the thread balloon is vibrating, the thread twist is almost dissolved. However, the thread twist is not dissolved if both twist generators produce air flows rotating in the same sense.

In the third embodiment of the invention according to FIGS. 6 and 7, the pneumatic twisting device which is designated with reference numeral 42 as a whole, has a twist generator 25 as in the preceding embodiment, which is mounted through an opening in the cover 9'. The twist generator 25 is also surrounded by the aforementioned sleeve 20, in which the connection tube 22 terminates, so that an annular channel 43 is formed. Otherwise, the twist generator 25 is constructed exactly like the twist generator of the preceding embodiment.

At the outside cover 9', a tube 45 is pushed onto the outer end of the twist generator 25, and is secured by the already mentioned clamping screw 34. At the end of tube 45, there is an additional clamping screw 34', which holds a second twist generator 46 that extends into the tube 45. In a similar manner, this twist generator 46 is also surrounded by a sleeve 47, so that an annular channel 44 is formed, in which a connection tube 48 terminates. In this embodiment as well, the two connection tubes 22 and 48 are connected to a source of compressed air which is not shown in the figure. Furthermore, in this embodiment, the end of the twist generator 46 is provided with a screw thread and with a nut 49, which ties the twist generator 46 and the sleeve 47 together.

The two twist generators 25 and 46 are sufficiently spaced apart from each other so that a balloon chamber 50 is formed between them inside the tube 45. The sectional view FIG. 7 shows that the balloon chamber 50 is provided with six disturbance elements 51. FIG. 6 shows that these disturbance elements are bar-shaped.

In this embodiment, when the two annular channels 43 and 44 are supplied with compressed air, and the thread 11 is pulled in the direction of an arrow 52, the thread is caused to vibrate with wave-like motions, and forms a thread balloon 11' in the balloon chamber 50.

Figure 5:
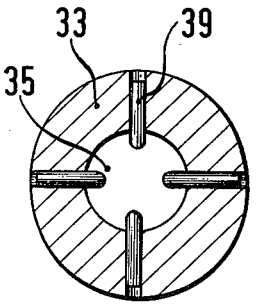
FIG. 5 is a cross-sectional view of the balloon chamber of the other twisting device.

The embodiment according to FIGS. 4 and 5 is advantageous with respect to the spinning technique, because the deflection of the thread 11 in the direction toward the draw-off device is gradual. However, the embodiment according to FIGS. 6 and 7 is advantageous with respect to its manufacture, because the parts are easier to make. However, the invention should not be limited to the illustrated and described embodiments.

For example, the pneumatic twisting device can be provided with a flow discharge line 53 which originates from the respective thread guide channel or from the respective balloon chamber, as shown in phantom in FIG. 6. A part of the air along with some of the fibers come loose from the thread, and can flow off through this discharge line, as they would through a bypass. As indicated in FIG. 1, this discharge line 53 can terminate in the feed-channel 5. Fibers that have been transported back can be mixed with the newly supplied fibers in this manner. However, the discharge line can also terminate in the rotor, for example, at the side adjacent the part of the pneumatic twisting device 12 which extends into the rotor 6, according to FIG. 1.

In the case of two twist generators connected in series, it is advantageous to let the discharge line 53 originate from the location at which the balloon chamber 50 is adjacent the thread guide channel 27 of the first twist generator 25, as shown in FIG. 6.

We claim:

1. Method for manufacturing a thread, which comprises introducing fibers into a rotor having a fiber collecting groove, combining the fibers in the collecting groove into a fiber ring gradually converting into a thread, conducting the thread in a given travel direction through a pneumatic twisting device discharging a quantity of air, bringing the thread in contact with an air stream in the pneumatic twisting device which rotates around the longitudial axis of the thread against the given travel direction of the thread, conducting fibers loosened from the thread back into the rotor with at least part of the quantity of air discharging from the pneumatic twisting device, drawing off the twisted thread leaving the pneumatic twisting device, and conducting the twisted thread to a thread collecting device.

2. Method according to claim 1, which comprises providing an initial deflection of the thread along the direction of the axis of rotation of the rotor at a deflection point, and bringing the thread in contact with the rotating air stream directly downstream of the deflection point for centrally conducting air and fibers into the rotor.

3. Device for manufacturing a thread in an open-end rotor spinning machine, comprising a rotor housing subjected to negative pressure, a rotor being disposed in said housing and having a fiber collecting groove for receiving a continuous supply of fibers and forming a fiber ring due to centrifugal forces being converted into a thread, a pneumatic twisting device being connected to said housing and having a thread guide channel formed therein through which the thread is conducted in a given travel direction, said thread guide channel having an opening for discharging in said housing, and said thread guide channel conducting air therethrough against said given thread travel direction at least at said opening thereof.

4. Device according to claim 3, including a thread draw-off device for receiving the thread from said pneumatic twisting device.

5. Device according to claim 4, including a thread collecting device for receiving the thread from said thread draw-off device.

6. Device according to claim 3, including a thread collecting device for receiving the thread from said pneumatic twisting device.

7. Device according to claim 3, wherein said opening of said thread guide channel is a funnel-shaped expanded thread draw-off nozzle disposed in said rotor.

8. Device according to claim 3, wherein said pneumatic twisting device is a twist generator having orifices formed therein for directing air tangentially against the thread.

9. Device according to claim 8, wherein the tangential directional component of said orifices faces in the same direction as the direction of rotation of said rotor.

10. Device according to claim 8, wherein the tangential directional component of said orifices faces in the direction opposite the direction of rotation of said rotor.

11. Device according to claim 8, wherein said pneumatic twisting device includes at least one other twist generator connected in series with said first-mentioned twist generator, and said opening is a common opening for each of said twist generators and is disposed in said rotor housing.

12. Device according to claim 11, wherein said pneumatic twisting device has a respective balloon chamber formed therein between each two twist generators for forming a thread balloon.

13. Device according to claim 12, including disturbance elements being disposed in said balloon chamber and being contacted by the thread balloon during rotation.

14. Device according to claim 12, wherein said pneumatic twisting device includes a discharge line originating from said thread balloon chamber.

15. Device according to claim 14, wherein said discharge line discharges in said rotor.

16. Device according to claim 14, wherein said discharge line discharges in a feed channel supplying the fibers to said rotor.

17. Device according to claim 11, wherein the air being conducted through said thread guide channel influences and encircles the thread in a different direction of rotation from one of said twist generators to the next.

18. Device according to claim 11, wherein the air conducted through said thread guide channel influences and encircles the thread with a different intensity in each of said twist generators.

19. Device according to claim 3, wherein said pneumatic twisting device is a twist generator having orifices formed therein for directing air obliquely against said given travel direction of the thread.

20. Device according to claim 3, wherein said housing includes a cover and said pneumatic twisting device is exchangeably mounted in said cover.

21. Device according to claim 3, wherein said pneumatic twisting device includes a discharge line originating from said thread guide channel.

22. Device according to claim 21, wherein said discharge line discharges in said rotor.

23. Device according to claim 21, wherein said discharge line discharges in a feed channel supplying the fibers to said rotor.

* * * * *